United States Patent [19]

Day et al.

[11] 3,942,430

[45] Mar. 9, 1976

[54] TRASH COMPACTOR

[76] Inventors: David Roger Day, 32397 Dolly Madison Drive, Apt. 25B, Madison Heights, Mich. 48071; Lucian Grant McElroy, 2206 Village West Drive North, Lapeer, Mich. 48446

[22] Filed: June 10, 1974

[21] Appl. No.: 477,787

[52] U.S. Cl. ..... 100/52; 100/53; 100/127; 100/250; 100/269 R; 100/272; 100/295; 53/124 B

[51] Int. Cl.[2] ..... B30B 15/22

[58] Field of Search ..... 214/82, 83.3; 100/295, 100/249, 250, 52, 127, 53, 269 R, 245, 233, 270, 271, 272, 179, 187, 240, 283; 74/96; 53/124 B

[56] References Cited

UNITED STATES PATENTS

| | | | |
|---|---|---|---|
| 856,803 | 6/1907 | Phillips | 100/295 X |
| 872,850 | 12/1907 | Rowekamp | 100/295 X |
| 2,084,806 | 6/1937 | Hubenet | 100/245 X |
| 2,293,679 | 8/1942 | Barker | 100/187 |
| 2,865,286 | 12/1958 | Newell | 100/295 |
| 3,039,383 | 6/1962 | Windle et al. | 100/240 |
| 3,100,423 | 8/1963 | Dalba | 74/96 UX |
| 3,274,922 | 9/1966 | Hefner | 100/52 |
| 3,353,478 | 11/1967 | Hopkins | 100/295 X |
| 3,580,166 | 5/1971 | Longo | 100/52 X |
| 3,772,983 | 11/1973 | Nichols | 100/295 |

*Primary Examiner*—Billy J. Wilhite
*Attorney, Agent, or Firm*—McGlynn and Milton

[57] ABSTRACT

A compactor assembly for compacting matter including a housing, a compactor plate within the housing movable between a retracted position and a compacting region for compacting matter wherein the compactor plate is inclined with respect to the path of motion in the retracted position and moves toward the perpendicular with respect thereto in the compacting region, the compactor plate including collapsible means for permitting collapse thereof as it approaches the perpendicular.

In one preferred embodiment, the compactor plate includes stapling means for stapling adjacent layers of matter together during the compaction process wherein the stapling means includes a plurality of movable teeth.

37 Claims, 10 Drawing Figures

TRASH COMPACTOR

This invention relates to compactors for compacting waste matter such as paper, bottles, cans, organic solids and other trash and waste materials.

In recent years, the amount of waste matter and refuse produced has increased tremendously and continues to increase. Finding satisfactory methods for disposing of all this waste matter has become a serious problem. Included among the solutions suggested are recycling and the using of waste matter as fuel. A major roadblock plaguing many of these potential solutions to the disposal problem, however, is the need to reduce the bulk waste matter to a form which can be handled easily and economically. For this reason, trash compactors must play an important role in any economically feasible plan for disposing of trash or refuse. Therefore, there is a great need for a compactor which is efficient, durable, and relatively simple in design and manufacture, yet is inexpensive.

Heretofore, most of the trash compactors, or related machines for baling, employ a compactor plate which is moved by suitable power means into compacting engagement with the matter being compacted. During such movement, the compactor plate remains in a plane which is perpendicular with respect to the direction or path of motion. Consequently, the compacting force developed is distributed equally over the entire face of the compactor plate, therefore, fixing the force per unit area acting upon the matter being compacted. Items of trash which would normally be crushed or compressed by the compactor plate can become wedged against the compactor plate and prevent further movement thereof. To alleviate such problems, trash compactors or balers have been provided with an inclined compactor plate which tends to roll the trash along in plow-like fashion to prevent jamming or wedging. The compactor plate in such compactors is pivotally mounted to the ram or other movable support mechanism so that it may assume an upright or perpendicular position when it engages the trash to compact the same. However, such devices disclosed having inclined compactor plates are subject to a serious defect in that there is a gap or space between the upper and lower edges of the compactor plate and the adjacent walls of the compactor housing when the compactor plate is in the inclined position. These gaps or spaces are, of course, required to allow the compactor plate to pivot to the upright or perpendicular. The problem, however, is that some of the matter being compacted can pass over or beneath the compactor plate and enter the area behind the compactor plate and eventually jam the compactor.

Another problem encountered in compactors or balers heretofore known involves the power means for moving the compactor plate. For example, compactor plate may be driven by a cylinder and piston arrangement, a driven screw, or a mechanical ram. Each of these mechanisms effectively move the compactor plate linearly, into and out of compacting engagement with the waste matter. The problem, however, is that a great deal of space is required for such "linear" actuators. The space requirement is particularly acute in vertical compactors since the height of the unit is limited by the height of the ceiling. Oftentimes, the height of the compactor is reduced by decreasing the length of the linear actuator. This is done, however, at the expense of a diminished range of motion in the compactor plate. Consequently, in many units, the compactor plate does not travel all the way to the end of the compaction cavity, thus reducing the efficiency of the compaction process.

Accordingly, the instant invention provides a compactor plate assembly including a compactor plate disposed within a compactor housing movable, through suitable power means, between a retracted position and a compacting region for compacting matter wherein the compactor plate is inclined with respect to the path of motion in the retracted position and moves toward the perpendicular with respect thereto in the compacting region. The compactor plate includes collapsible means for permitting collapse thereof as it approaches the perpendicular. Due to the collapsible means, the leading and trailing edges of the compactor plate remain in contact with the walls of the housing substantially throughout the movement of the compactor plate between the retracted position and the compacting region. Additionally, the compactor plate functions in plow-like fashion to roll the trash along in front of it to prevent jamming. Furthermore, as the compactor plate moves from the inclined position toward the perpendicular, a pincer-like crushing action is exerted on the trash.

The power means for moving the compactor plate includes a drive member which produces a rotary output and linkage means connecting the drive member to the compactor plate for translating the rotational motion of the drive member to linear motion. Preferably, the linkage means includes an arm member connected to the drive member for rotation therewith and a connecting arm pivotally connected to the arm member and to the compactor plate.

When metal cans, or other permanently deformable refuse of like nature, are being compacted, it is desirable to produce a cohesive bundle or block of compressed material which remains intact without the use of a container or of banding material. Accordingly, the instant invention provides a compactor plate which includes stapling means for stapling adjacent layers of matter together wherein the stapling means includes a plurality of movable teeth. The teeth are arranged in such fashion so as to staple adjacent layers of the cans together and are movable to permit release from the layers after the stapling function has been completed.

Other purposes and functions of the instant invention will be readily appreciated as the same becomes better understood by reference to the following detailed description when considered in connection with the accompanying drawings wherein.

Figure 5:
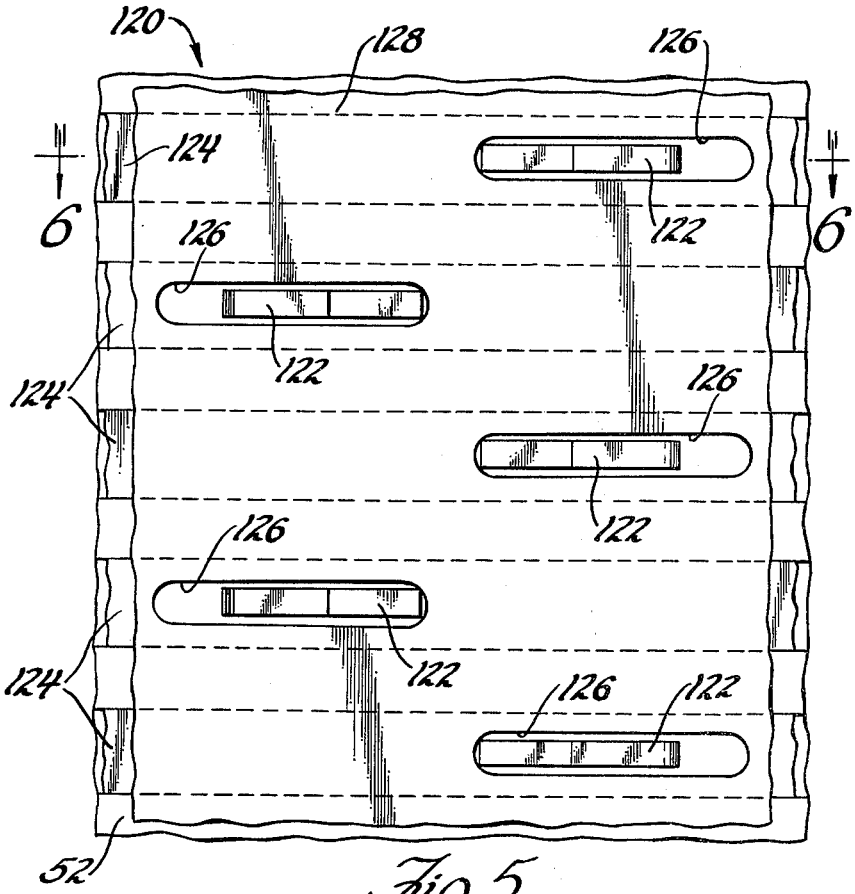
FIG. 5 is a broken-away enlarged view of a compactor plate constructed in accordance with the instant invention.
Figure 8:
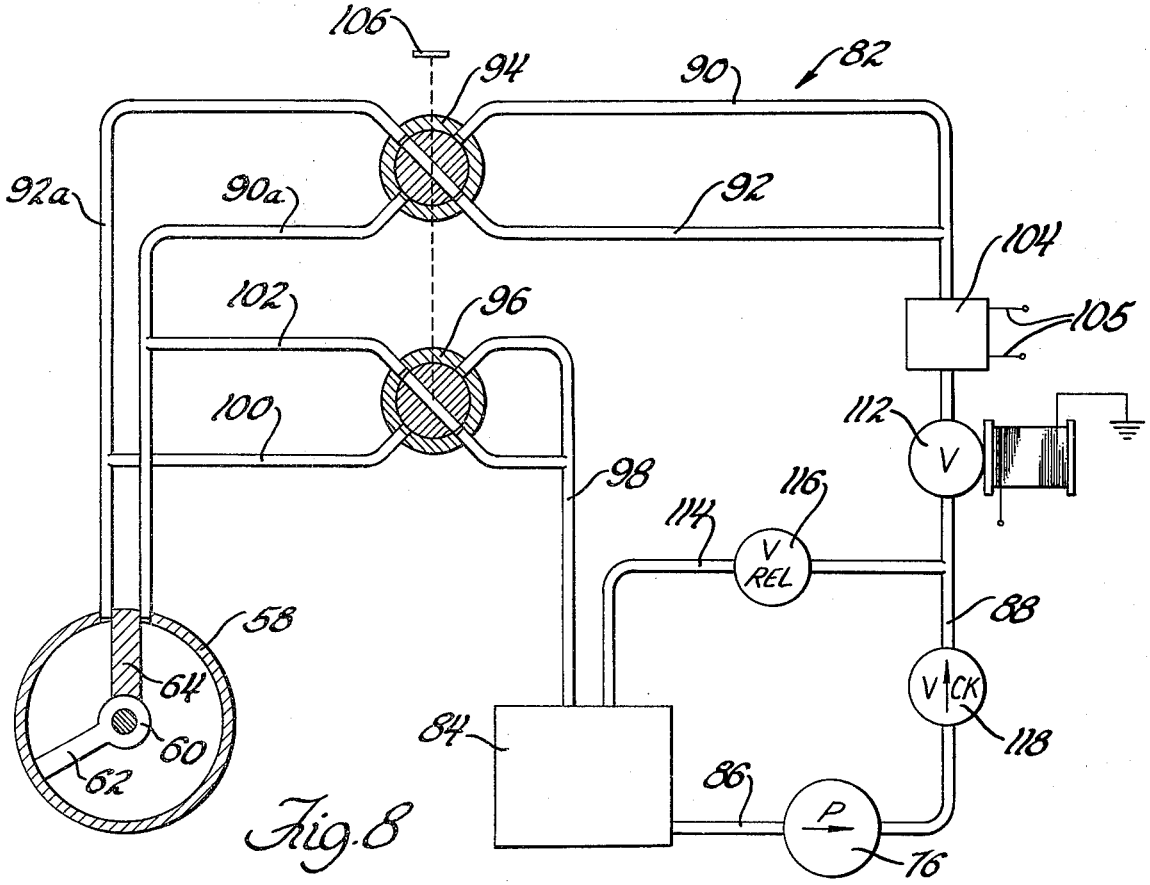

FIGS. *7a*, *7b* and *7c* illustrate the operation of the compactor plate means shown in FIG. 5; and FIG. 8 is a schematic view of a power system for use with the instant invention.

Figure 1:
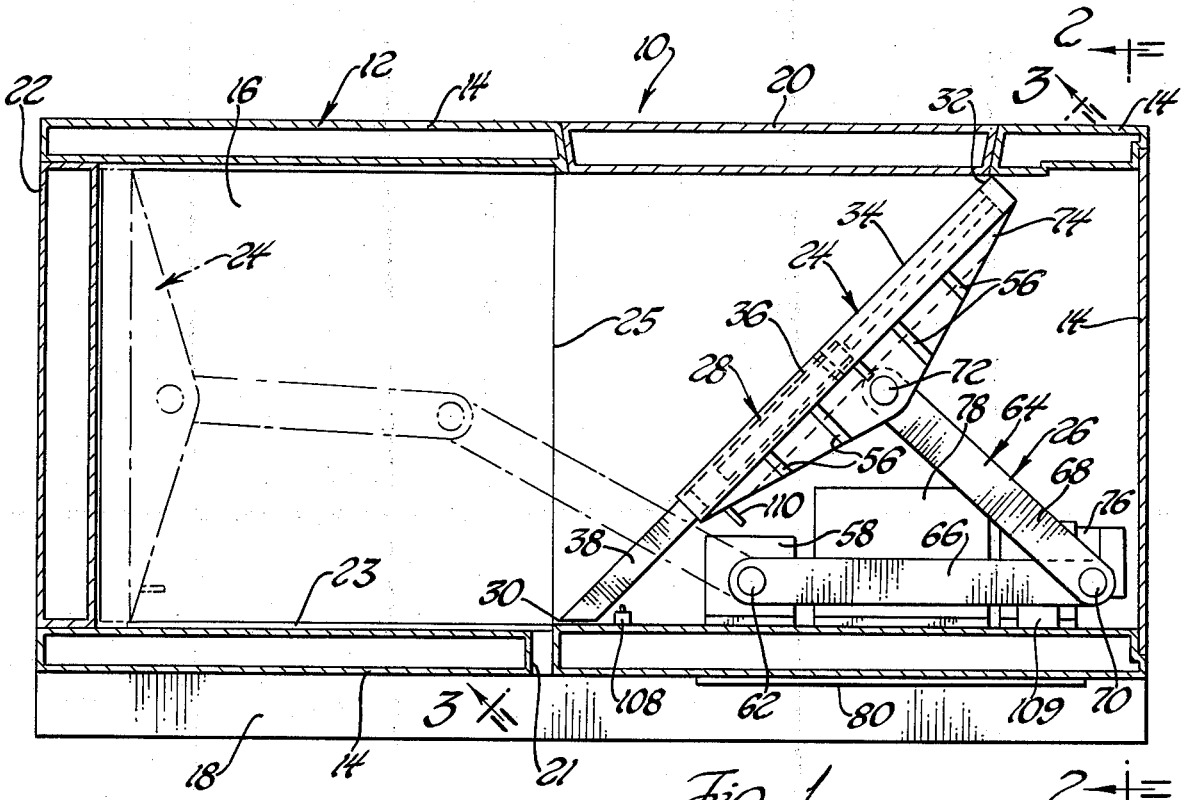
FIG. 1 is a cross-sectional elevational view of a preferred embodiment of the instant invention.
Figure 2:
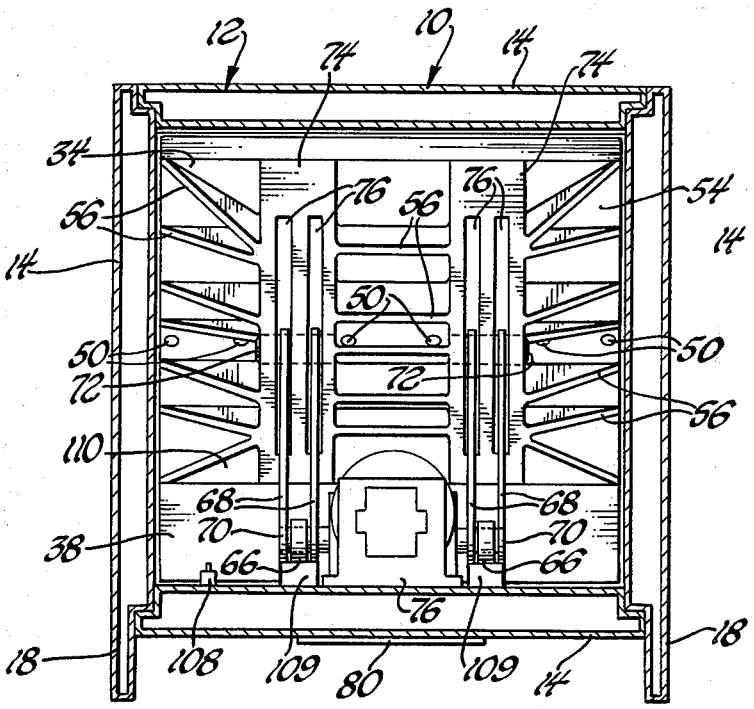
FIG. 2 is a cross-sectional view taken generally along line 2—2 of FIG. 1.

Referring to the drawings, a compactor assembly for compacting matter is generally shown at 10 in FIGS. 1 and 2. The compactor assembly 10 includes a housing, generally indicated at 12, having a plurality of walls 14 of suitable structural material which form a cavity 16 within the housing 12. The side walls 14 of the housing 12 may be provided with depending extensions 18 which serve as legs to support the compactor assembly 10 in a horizontal position as shown. It is noted, however, that the horizontal compactor assembly 10 is shown by way of example and that the instant invention is similarly applicable to a vertical or upright compactor assembly. The housing 12 is further provided with a loading door 20 through which waste matter can be introduced into the housing 12 and an unloading door 22 through which the waste matter can be removed from the housing 12 after compaction. Both of the doors 20 and 22 are provided with suitable hardware (not shown) such as hinges and latches for permitting opening and closing movement of the doors 20 and 22 and for securing the doors in the closed position.

The floor of the housing 12 may be provided with one or more drain openings 21 to permit escape of liquids squeezed from the waste matter being compacted. A drain pan (not shown) may be disposed beneath the housing 12 to cath the liquids escaping through the drain openings 21 or suitable drainage pipes may be connected to the drain openings 21 to conduct the escaping liquids to a sanitary drain or the like.

The portion of the cavity 16 of the housing 14 adjacent the unloading door 22 is adapted to receive a container 23, such as a hard paper box, open at its inner end 25, into which the waste matter may be compacted. In the compactor assembly shown, the interior surfaces of the walls 14 are suitably recessed so that the walls of the container 23 will be flush with the remaining wall sections. In some cases it will not be necessary to employ the container 23. In such cases, a liner, open at both ends, is employed to fill the recessed areas of the walls 14.

Compactor plate means, generally indicated at 24, is disposed within the housing 12 and is movable by suitable power means, generally shown at 26, between a retracted position, shown in FIG. 1 in solid lines, and a compacting region for compacting matter. The compacting region generally comprises the open space between the compactor plate means 24 in the retracted position and the unloading door 22, which region is available for receiving waste matter. As shown in FIG. 1, the compactor plate means 24 is inclined or tilted with respect to the path of motion in the retracted position and moves toward the perpendicular with respect to the path of motion in the compacting region. The perpendicular position of the compactor plate means 24 is shown in phantom in FIG. 1.

The height of the compactor plate means 24 must be greater in the inclined position to cover the distance between the upper and lower walls 14 of the housing 12 than in the upright or perpendicular position. Accordingly, the compactor plate means 24 includes collapsible means, generally indicated at 28, for permitting collapse of the compactor plate means as it approaches the perpendicular. In other words, the compactor plate means 24 includes a leading edge 30 and a trailing edge 32 wherein the distance between the edges 30 and 32 diminishes as the compactor plate means 24 approaches the perpendicular.

More specifically, the compactor plate means 24 includes a body member 34 having an internal cavity 36 for telescopically receiving a retractable member 38. The collapsible means 28 includes resilient means, such as the coil spring members 40, disposed between the body member 34 and the retractable member 38 for permitting collapse of the compactor plate means 24 by telescopic movement between the body member 34 and the retractable member 38. The coil spring members 40, however, also urge expansion of the compactor plate means 24; that is, the coil spring members 40 urge the retractable member 38 to the extended position.

Figure 3:
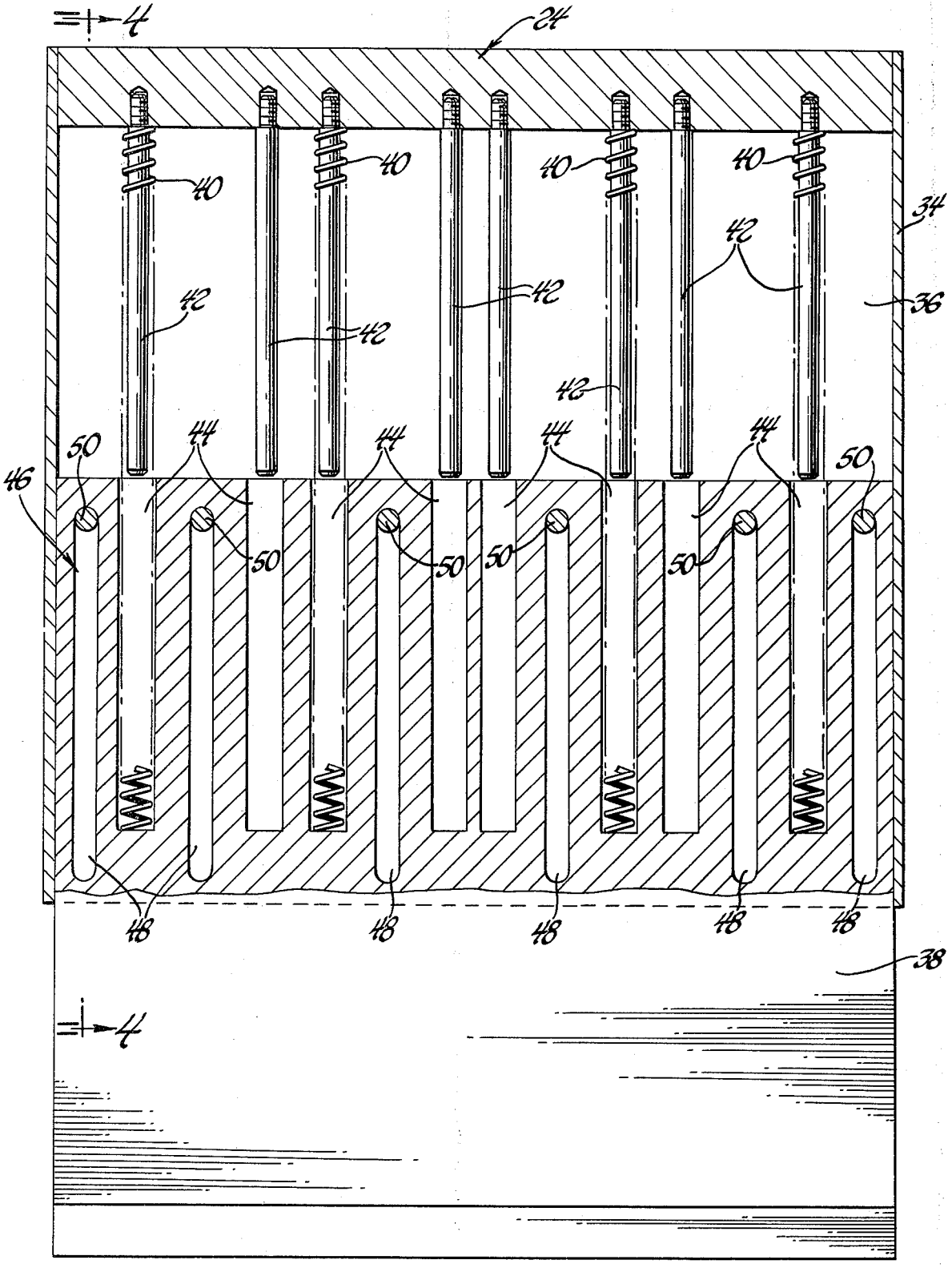
FIG. 3 is a cross-sectional view of the compactor plate means of the instant invention taken generally along line 3—3 of FIG. 1.

The body member 34 is provided with a plurality of spring-retaining pins 42 which are in axial alignment with spring-receiving bores 44 in the retractable member 38. As shown in FIG. 3, the body member 34 and the retractable member 38 are provided with eight sets of spring-retaining pins 42 and spring-receiving bores 44; however, only four of the sets are provided with coil spring members 40. Accordingly, additional coil spring members 40 may be added for increasing the spring force or resistance to collapse which is afforded by the coil spring members 40. Conversely, one or more of the coil spring members can be removed to reduce the spring force resisting collapse of the compactor plate means 24.

Figure 4:
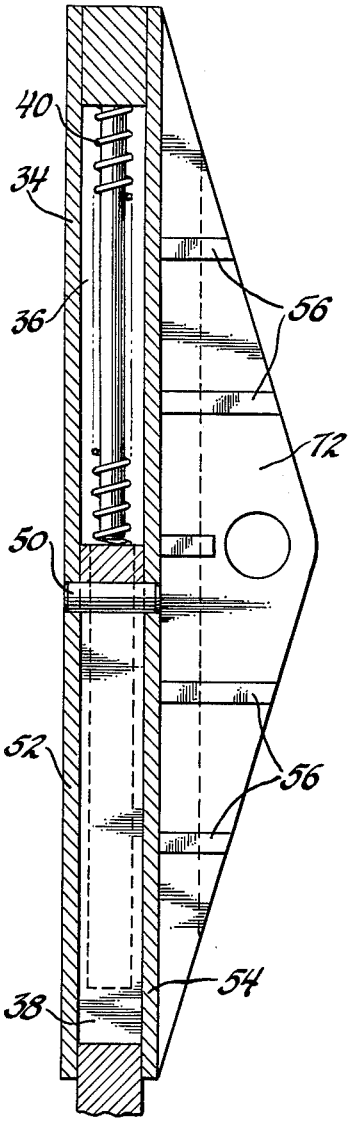
FIG. 4 is a view taken generally along line 4—4 of FIG. 3.

The compactor plate means also includes guide means, generally indicated at 46, for guiding the movement between the body member 34 and the retractable member 38. The guide means 46 includes a plurality of guide slots 48 in the retractable member 38 and a plurality of guide pins 50 in the body member 34 which are in cooperating engagement with the guide slots 48. As shown in FIG. 4, the guide pins 50 extend between the forward walls 52 and rear wall 54 of the compactor plate means 24.

The rear wall 54 of the compactor plate means 24 may be provided with reinforcing ribs 56 for increasing the structural strength of the compactor plate means.

In operation, waste matter is introduced into the cavity 16 through the loading door 20. The loading door 20 is then closed and locked in place and the power means 26 is activated to move the compactor plate means 24 toward the left, as viewed in FIG. 1. Initially, as the compactor plate means 24 advances through the compacting region, it remains in the inclined or tilted position. Due to the inclined position of the compactor plate means 24, the waste matter will be moved or rolled by the plow-like action of the compactor plate means 24. Consequently, elongated objects which would normally tend to wedge between the compactor plate means 24 and the unloading door 22 are picked up by the leading edge 30 of the retractable member 38 and lifted out of the way.

During the initial plowing action of the compactor plate means 24, the retractable member 38 remains extended due to the force of the spring members 40. Eventually, however, as enough waste matter is built up and compressed against the unloading door 22, the force exerted on the leading edge 30 of the retractable member 38 begins to overcome the force of the spring members 40. When this occurs, the retractable member 38 moves telescopically into the body member 34 and the compactor plate means 24 moves toward the perpendicular due to the force exerted behind the compactor plate means 24 by the power means 26. Such movement toward the perpendicular is unrelated to the location of the compactor plate means 24 in the housing 12, but depends on the amount of compacted matter therein. As more waste matter is introduced into the compactor assembly during subsequent compacting cycles, the compactor plate means 24 will move toward the perpendicular at positions farther removed to the right from the unloading door. For purposes of illustration, FIG. 1 shows the final position of the compactor plate means 24 when the compactor assembly is empty. In other words, the compactor plate means 24 remains in the inclined position until the retractable member 38 meets the unloading door 22. The unloading door 22 resists further forward motion of the retractable member 38 so that the compactor plate means 24 moves toward the perpendicular.

Due to the spring force, the compactor plate means 24 does not pivot freely toward the perpendicular. The reaction force of the matter being compacted must always exceed the spring force. Consequently, a pincer-like force is exerted on the matter as the compactor plate means moves toward the perpendicular. This pincer-like action tends to concentrate the force exerted by the power means 26, thereby increasing the compacting capability. Such pincer-like action is particularly helpful in crushing hard objects such as glass bottles and metal cans. Another important feature is that the spring members 40 keep the leading edge 30 and trailing edge 32 in constant engagement with the adjacent walls 14 to prevent gaps.

As indicated above, the compactor assembly 10 includes power means 26 for moving the compactor plate means 24 between the retracted position and the compacting region. It should be apparent that a number of various mechanical, electrical or hydraulic power sources which produce a linear output only may be employed successfully in the compactor assembly 10 to provide the power means. However, the specific power means is particularly well suited for the compactor assembly 10 and contribute advantages to the compactor assembly 10 which have heretofore been unknown since it comprises a drive mechanism producing a rotary output.

Specifically, the power means 26 includes drive means comprising a hydraulically driven rotary actuator 58 of well known design. More specifically, and referring to FIG. 8, the rotary actuator 58 includes a rotatably supported shaft 60 within the actuator to which a vane 62 is attached. The vane 62 and an internal wall 64 define two cavities within the rotary actuator 58. Supplying hydraulic fluid, under pressure, to one of the cavities causes the vane 62 and the shaft 60 to rotate due to the generally incompressible nature of the hydraulic fluid.

With reference to FIG. 1, the rotatable shaft 60 includes an integral shaft extension 62 extending from each side thereof. Linkage means, generally indicated at 64, connects the compactor plate means 24 to the shaft extension 62 of the rotary actuator 58 for translating the rotational output of the rotary actuator 58 into linear motion for moving the compactor plate means 24. The linkage means 64 includes a pair of arm members 66 which are connected to the shaft extensions 62 for rotational movement therewith. A pair of connecting arms 68 are pivotally attached to each of the arms 66 by pins 70 and to the rear wall 54 of the body member 34 of the compactor plate means 24 by pins 72. To provide the connection between the connecting arms 68 and the compactor plate means 24, the rear wall 54 thereof is provided with a pair of rearwardly extending, triangularly shaped flange portions 74, each of which includes a pair of slots 76 for receiving the ends of the connecting arms 68. The ends of the connecting arms and the flange members 74 include apertures for receiving the pins 72 to complete the pivotal connection.

Although a hydraulically driven rotary actuator is described, it is noted that other drive means may be employed which gives a rotary output. In other words, any mechanical, electrical, or hydraulic unit which produces a rotary drive may be employed to move the compactor plate means 24, such units being generally characterized as "rotary" actuators. The use of a rotary actuator saves space, an attribute which is particularly important in vertical compactor assemblies. Since the range of motion of the compactor plate means 24 is less dependent upon space limitations due to the use of a rotary actuator, the length of the arm members 66 and connecting arms 68 are made so that the compactor plate means 24 is capable of traveling the entire distance to the end of the compaction cavity 16, in short, all the way to the unloading door 22. Furthermore, since the linkage mechanism is structurally more stable than many of the cylinder-piston arrangements, guide rails within the compactor housing for guiding the compactor plate can be eliminated.

The power means 26 further includes fluid pump means for providing hydraulic fluid, under pressure, to the rotary actuator 58. The fluid pump means comprises a pump 76 and a motor 78 for driving the pump. The rotary actuator 58, the pump 76, and the motor 78 may all be secured to the bottom wall 14 of the compactor assembly 10 by means of an anchor plate 80. Suitable bolts (not shown) extend between the individual elements and the anchor plate 80 to hold the elements in place. Included in the power means 26 is control means, generally shown at 82 in FIG. 8, for controlling the movement of the compactor plate means 24. The control means 82, shown in schematic in FIG. 8, is a suitable hydraulic control system for operating the compactor assembly 10. It is noted, however, that various other control systems may be designed which provide comparable results once the intended functions of the control means 82 is recognized. The specific arrangement of the control means 82 is, therefore, intended to be exemplary only and the invention is not limited to the specific details thereof.

Appropriate electronic circuitry is provided for cooperation with the control means for operating the compactor assembly 10. Generally, the electronic circuitry includes a main "on" switch for initially activating the motor 78 and pump 76. A sequencing device is also provided which automatically reverses the direction of motion of the compactor plate means 24 after it has completed its compacting function to return it to the retracted position and also automatically shuts the power off when the compactor plate means 24 reaches the retracted position. The design of such a sequencing device is well within the capability of the skilled technician and, therefore, the specific details thereof need not be shown due to the many possible alternatives. Suffice it to say that the specific electronic circuitry is not critical to the operation of the compactor assembly and that the following description is made for the purpose of setting forth the best mode of operation presently known.

The control means 82 includes a hydraulic fluid reservoir 84 which is connected to the pump 76 through a line 86. Hydraulic fluid, under pressure, passes from the pump 76 through a main supply line 88 which divides into two branches 90 and 92. Fluid flow through the branches 90 and 92 is controlled by means of a rotary valve 94. In other words, the position of the rotary valve 94 determines whether fluid will be permitted to pass from branch 92 to branch 92*a* to supply hydraulic fluid to the left side of the rotary actuator 58 or from branch 90 to branch 90a to supply fluid to the right side of the rotary actuator 58. Another rotary valve 96 is provided for controlling the flow of hydraulic fluid away from the rotary actuator 58 to a main return line 98 which returns the hydraulic fluid to the reservoir 84. To accommodate return flow, both of the branches 92a and 90a include return lines 100 and 102, respectively, which are connected to the second rotary valve 96.

By way of example, when the rotary valves 94 and 96, which act in unison, are in the positions shown in FIG. 8, hydraulic fluid is conducted through the main supply line 88, branch 92, rotary valve 94, and branch 92*a* to the left side of the rotary actuator 58. The pressure of the hydraulic fluid forces the vane 62 and the shaft 60 to rotate in a counterclockwise direction. Counterclockwise motion of the shaft 60 tends to move the compaction plate means 24 in a direction from the retracted position through the compacting region. Hydraulic fluid on the right side of the rotary actuator 58 escapes through branch 90*a*, line 102, rotary valve 96, and main return line 98 to the reservoir 84. Reversing the rotary valves 94 and 96 causes hydraulic fluid to flow through branch 90, rotary valve 94, and branch 90a to the right side of the rotary actuator 58, thereby causing the vane 62 and the shaft 60 to rotate in a clockwise direction. Clockwise rotation of the shaft 60 tends to move the compactor plate means 24 from the compacting region to the retracted position. Hydraulic fluid escapes from the left side of the rotary actuator through branch 92*a*, line 100, rotary valve 96, and main return line 98 to the reservoir 84.

The control means further includes pressure responsive means 104 responsive to a predetermined level of pressure exerted by the compactor plate means 24 on the matter being compacted for returning the compactor plate means 24 to the retracted position from the compacting region. More specifically, when the compactor assembly 10 is being loaded, the compactor plate means 24 is in the retracted position, as shown in FIG. 1. When the pump 76 is activated by the main switch to start the compaction process, the rotary valves 94 and 96 are in the positions shown in FIG. 8 and hydraulic fluid is supplied to the left side of the rotary actuator 58, thereby causing the compactor plate means 24 to move from the retracted position through the compacting region. As the compactor plate means 24 meets the compresses the matter to be compacted, resistance to further movement of the compactor plate means 24 increases, thereby creating a pressure buildup in main supply line 88. When the pressure buildup reaches a predetermined level, the pressure responsive means 104, which is connected to the electric sequencing device by leads 105, causes the sequencing device to reverse the positions of the rotary valves 94 and 96 through a switching device 106. Reversing the direction of flow through the rotary actuator 58 moves the compactor plate means 24 from the compacting region to the retracted position.

When the compactor plate means 24 reaches the retracted position, the arms 66 engage rest pads 109 which prevent further motion and the pressure in the main supply line 88 again builds up. When the pressure in main supply line 88 again reaches the predetermined level, the pressure responsive means 104 produces a signal. The second signal transmitted by the pressure responsive means 104 causes the sequencing device to shut off the power to the pump 76. In other words, the first signal from the pressure responsive means 104 causes the sequencing device to reverse the rotary valves 94 and 96 to automatically move the compactor plate means 24 toward the retracted position after compaction, and the second signal from the pressure responsive means 104 causes the sequencing device to automatically shut off the power. Alternatively, an electric switch may be provided which is thrown when the compactor plate means reaches the retracted position to shut off the power. In short, it is only necessary that the control means includes some type of first power shutoff means for stopping the motion of the compactor plate means 24 when it reaches the retracted position.

After the compactor plate means 24 has completed one cycle, that is, after it has moved from the retracted position, compacted the matter in the compacting region and returned to the retracted position, additional waste matter may be introduced for compaction. In other words, the compactor assembly 10 is loaded and recycled a number of times until the compacted waste matter fills the volume of the housing available for compaction purposes. When such volume is filled, it is desirable to disable the compactor assembly to prevent introduction of additional waste matter which would be excessive. Accordingly, power shutoff means is provided for stopping the motion of the compactor plate means in the compacting region when the compactor plate means becomes perpendicular at a predetermined location in the housing corresponding to a filled condition.

This predetermined position is reached when the compactor plate means 24 is no longer capable of moving to the left from the retracted position as shown in FIG. 1. In other words, the compacted waste matter fills the entire, generally rectangular, space between the unloading door 22 and the leading edge 30 of the retractable member 38 defined by the container 21. Accordingly, when this situation exists, the compactor plate means 24 merely pivots about its leading edge 30 as it moves from the inclined position toward the perpendicular without any substantial forward linear movement. To shut the power off under these conditions, an electric switch 108 is disposed on the bottom wall 14 of the housing, as shown in FIG. 1. The electric switch 108 is connected to a solenoid-operated valve 112 in the main supply line 88. When the compactor plate means 24 reaches the perpendicular position adjacent the switch 108, a lever 110 on the body member 34 throws the switch 108 thereby activating the solenoid-operated valve 112 in the main supply line 88 to shut off fluid flow to the rotary actuator 58. The switch 108 may also be employed to activate solenoid-actuated latch members for locking the loading door 20 closed. Accordingly, further loading or operation of the compactor assembly 10 is precluded. The compactor assembly 10 must then be unloaded by opening the unloading door 22. Such operations function to reset the switch 108 and to release the loading door 20 to permit subsequent operation of the compactor assembly.

The main supply line 88 is also connected to the reservoir through a line 114 which includes a relief valve 116. In the event that the pressure in line 88 builds up to an excessive level due to some malfunction in the system, the relief valve 116 opens to allow hydraulic fluid to pass from the main supply line 88 to the reservoir 84 to prevent damage to the components of the assembly. The main supply line 88 also includes a check valve 118 to prevent backflow through the pump 76. Consequently, the compactor assembly 10 may be manually shut off when the compactor plate means 24 is exerting compacting pressure on the waste matter to maintain such pressure on the waste matter when the compactor assembly is not in use.

Figure 6:
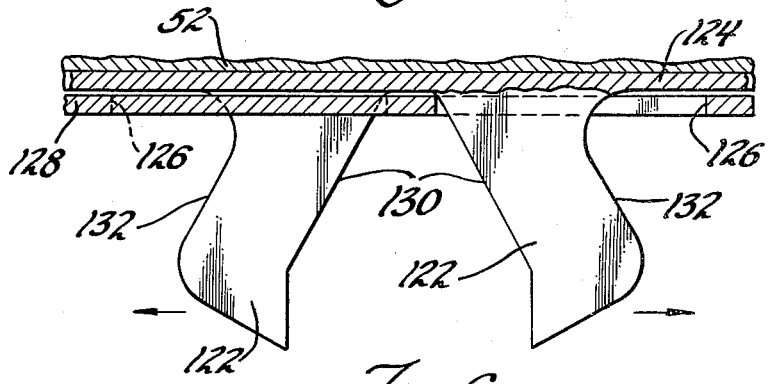
FIG. 6 is a view taken generally along line 6—6 of FIG. 5.

Oftentimes, waste matter which is being compacted is relatively permanently deformable, such as when metal cans are being crushed. In such instances, it is desirable that the cans be joined in some manner so as to produce a cohesive bundle or block which will remain intact without the use of a container or banding material. Accordingly, compactor plate means, generally shown at 120 in FIG. 5, includes stapling means for stapling adjacent layers of matter together. The stapling means includes a plurality of movable teeth 122 which are supported in parallel rows by movable support bars 124. As best shown in FIG. 6, the teeth 122 in each row face in a direction opposite to that of immediately adjacent rows such that adjacent rows move in opposite directions as will become better understood hereinafter.

Each of the teeth 122 extends through an elongated aperture 126 disposed in a support plate member 128. The support plate member 128 is adapted for attachment to the forward face 52 of the compactor plate means 24. The support plate member 128 is preferably removably connected to the forward face 52 of the compactor plate means 24 so that it may be mounted or removed therefrom in view of the waste matter to be compacted. In other words, the stapling means 120 would not generally be required when paper, cardboard, or organic wastes are being compacted. In such cases, the stapling means 120 can be removed until such time that metal cans are being compacted.

Each of the movable teeth 122 includes a first cam surface 130 engageable with the matter being compressed for moving the tooth 122 in a first direction and a second cam surface 132 engageable with the matter being compressed for moving the tooth 122 in a second direction. The teeth 122 also include deforming means 134 for deforming the matter laterally with respect to the path of motion of the compactor plate means 24 while the teeth 122 are moving in the first direction. FIGS. *7a*, *7b* and *7c* illustrate the operation of the stapling means. In these figures, layers of material 136 are shown by way of example only. Of course, in actual operation of the compactor plate means 24, it would simultaneously crush and staple the cans together. For convenience, the waste matter is shown in layers and these figures merely illustrate the movement of the teeth 122.

Figure 7A:
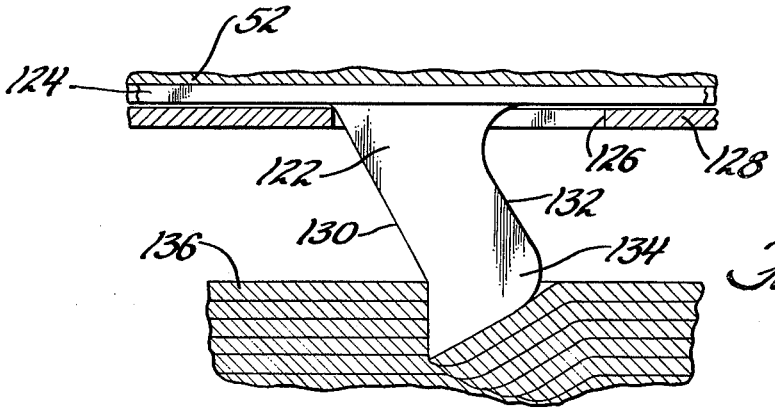
Figure 7B:
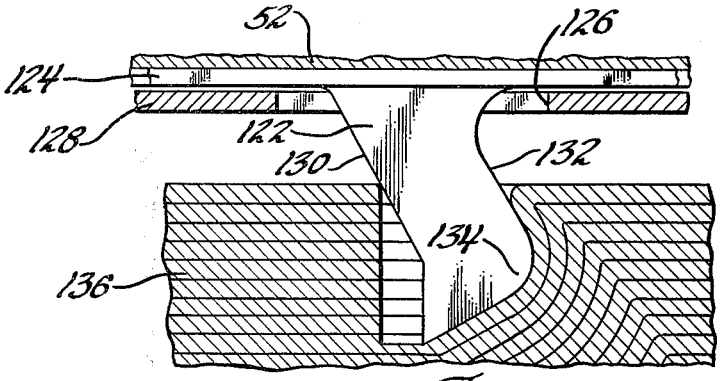
Figure 7C:
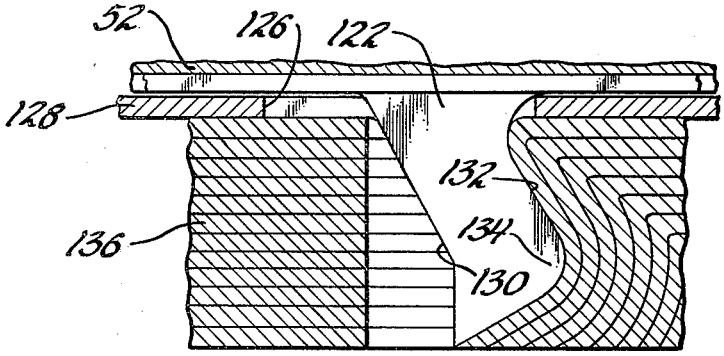

Specifically, when the teeth first engage the matter to be operated upon, they are positioned at the side of the aperture 126 adjacent the first cam surface 130 as shown in FIG. 6. As shown in FIG. 7, the teeth 122 remain stationary with respect to the elongated aperture 126 during initial penetration of the waste matter 136. However, as the compactor plate means advances toward the matter 136 causing further penetration of the teeth 122, the matter engagess the first cam surface 130 and forces the teeth 122 to move laterally with respect to the direction of motion of the compactor plate means (as indicated by the arrows in FIG. 6). Such lateral motion causes the deforming means 134, comprising a laterally extending shoulder, to move or deform the matter 136 laterally. Keeping in mind that adjacent rows of teeth are moving in the opposite direction, the lateral movement of material is sufficient to staple or lock adjacent rows of matter 136 together. The extent of lateral motion of the teeth 122 is limited by the length of the elongated aperture so that the teeth 122 come to rest. In other words, when the teeth 122 engage the end of the aperture 126 adjacent cam surface 132, lateral motion is terminated.

When the compactor plate assembly is moved away from the matter 136 toward the retracted position, it is necessary to release the teeth 122 from the matter in such a manner so as to prevent pulling the layers of matter apart. In other words, it is necessary to maintain the stapled condition. This function is accomplished by the second cam surface 132 which engages the matter 136 upon withdrawal to move the teeth 122 in a second direction, opposite to the first direction, to disengage the deforming shoulder 134 from the matter. By way of example, the tooth 122 shown in FIG. 7 moves to the left as the compactor plate means 24 moves away from the matter. In this way, the teeth 122 can be removed without disturbing the stapled condition. Accordingly, layers of matter, such as metal cans, can be built up into a cohesive block or bundle for easy handling upon removal.

The invention has been described in an illustrative manner, and it is to be understood that the terminology which has been used is intended to be in the nature of words of description rather than of limitation.

Obviously, many modifications and variations of the instant invention are possible in light of the above teachings. It is, therefore, to be understood that the invention may be practiced otherwise than as specifically described and yet remain within the scope of the depending claims.

The embodiments of the invention in which an exclusive property or privilege is claimed are defined as follows:

1. A compactor assembly for compacting matter comprising: a housing, compactor plate means within said housing movable along a path of motion between a retracted position and a compacting region for compacting matter wherein said compactor plate means is inclined with respect to the path of motion in said retracted position and moves toward the perpendicular with respect thereto in said compacting region, said compactor plate means including a leading edge and a trailing edge, said edges being in continuous contact with opposite surfaces of said housing, and means mounting said edges for permitting relative movement therebetween to reduce the distance between said edges as said compactor plate means approaches the perpendicular whereby said edges contact the walls of said housing throughout the movement of said compactor plate means, and power means for moving said compactor plate means.

2. An assembly as set forth in claim 1 wherein said means is collapsible and includes resilient means for urging expansion of said compactor plate means.

3. An assembly as set forth in claim 2 wherein said compactor plate means includes a body member and a retractable member.

4. An assembly as set forth in claim 3 wherein said body member includes an internal cavity for telescopically receiving said retractable member.

5. An assembly as set forth in claim 4 wherein said resilient means includes at least one spring member disposed between said body member and said retractable member.

6. An assembly as set forth in claim 5 wherein said compactor plate means includes guide means for guiding the movement between said body member and said retractable member.

7. An assembly as set forth in claim 6 wherein said guide means includes a plurality of guide slots in said retractable member and a plurality of guide pins in said body member in cooperating engagement with said guide slots.

8. An assembly as set forth in claim 7 wherein said retractable member includes a plurality of spring-receiving bores.

9. An assembly as set forth in claim 8 wherein said body member includes a plurality of spring retaining pins in axial alignment with said spring-receiving bores.

10. An assembly as set forth in claim 9 wherein said compactor plate means includes stapling means for stapling adjacent layers of matter together, said stapling means including a plurality of movable teeth.

11. An assembly as set forth in claim 10 wherein said stapling means includes a support plate member and a plurality of elongated apertures in said support plate member, each aperture receiving one of said movable teeth for limiting the extent of movement thereof.

12. An assembly as set forth in claim 11 wherein each of said movable teeth includes a first cam surface engageable with the matter being compacted for moving said teeth in a first direction and a second cam surface engageable with the matter for moving said teeth in a second direction.

13. An assembly as set forth in claim 12 wherein said stapling means includes a plurality of support bars for supporting said teeth in parallel rows.

14. An assembly as set forth in claim 13 wherein said teeth in each row face in a direction opposite to that of immediately adjacent rows such that adjacent rows move in opposite directions.

15. An assembly as set forth in claim 14 wherein said rows of teeth extend transversely of the path of motion of said compactor plate means.

16. An assembly as set forth in claim 15 wherein said power means includes control means for controlling the movement of said compactor plate means, said control means including first power shutoff means for stopping the motion of said compactor plate means when it reaches the retracted position and second power shutoff means for stopping the motion of said compactor plate means in the compacting region when the compactor plate means becomes perpendicular at a predetermined location in said housing.

17. An assembly as set forth in claim 16 wherein said control means includes pressure responsive means responsive to a predetermined level of pressure exerted by said compactor plate means on the matter for returning the compactor plate means to the retracted position from the compacting region.

18. An assembly as set forth in claim 17 wherein said power means includes a rotary actuator means and linkage means for connecting said actuator means to said compactor plate means.

19. An assembly as set forth in claim 18 wherein said rotary actuator means is hydraulically driven and said power means includes fluid pump means for providing fluid to said rotary actuator means and valve means for controlling the direction of flow through said rotary actuator means.

20. An assembly as set forth in claim 1 wherein said compactor plate means includes stapling means for stapling adjacent layers of matter together, said stapling means including a plurality of movable teeth.

21. An assembly as set forth in claim 20 wherein said stapling means includes a support plate member and a plurality of elongated apertures in said support plate member, each aperture receiving one of said movable teeth for limiting the extent of motion thereof.

22. An assembly as set forth in claim 21 wherein each of said movable teeth includes a first cam surface engageable with the matter being compressed for moving said tooth in a first direction and a second cam surface engageable with the matter being compressed for moving said tooth in a second direction.

23. An assembly as set forth in claim 22 wherein said teeth include deforming means for deforming matter laterally with respect to the path of motion of the compactor plate means.

24. An assembly as set forth in claim 23 wherein said stapling means includes a plurality of support bars for supporting said teeth in parallel rows.

25. An assembly as set forth in claim 24 wherein said teeth in each row face in a direction opposite to that of immediately adjacent rows such that adjacent rows move in opposite directions.

26. An assembly as set forth in claim 25 wherein said rows of teeth extend transversely of the path of motion of said compactor plate means.

27. An assembly as set forth in claim 1 wherein said power means includes control means for controlling the movement of said compactor plate means, said control means including first power shutoff means for stopping the motion of said compactor plate means when it reaches the retracted position and second power shutoff means for stopping the motion of said compactor plate means in the compacting region when the compactor plate means becomes perpendicular at a predetermined location in said housing.

28. An assembly as set forth in claim 27 wherein said control means includes pressure responsive means responsive to a predetermined level of pressure exerted by said compactor plate means on the matter for returning the compactor plate means to the retracted position from the compacting region.

29. An assembly as set forth in claim 28 wherein said power means includes rotary actuator means and linkage means connecting said actuator means to said compactor plate means.

30. An assembly as set forth in claim 29 wherein said rotary actuator means is hydraulically driven and said power means includes fluid pump means for providing fluid to said rotary actuator means and valve means for controlling the direction of flow through said rotary actuator means.

31. A compactor plate assembly comprising:

a movable compactor plate member, stapling means carried by said compactor plate member for stapling adjacent layers of matter together, said stapling means including a plurality of movable teeth, support bars for supporting said teeth, a support plate member, a plurality of elongated apertures in said support plate member, each aperture receiving one of said movable teeth for limiting the extent of travel thereof during relative motion between said support bars and said support plate member.

32. An assemly as set forth in claim 31 wherein each of said movable teeth includes a first cam surface engageable with the matter for moving said tooth in a first direction and a second cam surface engageable with the matter for moving said tooth in a second direction.

33. An assembly as set forth in claim 32 wherein said teeth include deforming means for deforming matter laterally with respect to the path of motion of the compactor plate means.

34. An assembly as set forth in claim 32 wherein said teeth in each row face in a direction opposite to that of immediately adjacent rows such that adjacent rows move in opposite directions.

35. An assembly as set forth in claim 34 wherein said rows of teeth extend transversely of the path of motion of said compactor plate means.

36. A compactor assembly for compacting matter comprising: a housing, compactor plate means within said housing movable between a retracted position and a compacting region for compacting matter wherein said compactor plate means is inclined with respect to the path of motion in said retracted position and moves toward the perpendicular with respect thereto in said compacting region, said compactor plate means including a body member, a retractable member retractably associated with said body member, and resilient collapsible means acting between said body member and said retractable member for permitting collapse of said compactor plate means as it approaches the perpendicular, and power means for moving said compactor plate means.

37. A compactor plate assembly for compacting matter comprising: a housing, compactor plate means within said housing movable between a retracted position and a compacting region for compacting matter wherein said compactor plate is inclined with respect to the path of motion in said retracted position and moves toward the perpendicular with respect thereto in said compacting region, said compactor plate means including a body member, a retractable member retractably associated with said body member, said members defining a leading edge and a trailing edge, said edges being in continuous contact with opposite surfaces of said housing, and resilient collapsible means acting between said body member and said retractable member for permitting the distance between said edges to diminish as said compactor plate means approaches the perpendicular, and power means for moving said compactor plate means.

* * * * *